US009254669B2

(12) United States Patent
Yoshida et al.

(10) Patent No.: US 9,254,669 B2
(45) Date of Patent: Feb. 9, 2016

(54) LIQUID EJECTING APPARATUS

(71) Applicant: SEIKO EPSON CORPORATION, Tokyo (JP)

(72) Inventors: Atsushi Yoshida, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/169,000

(22) Filed: Jan. 30, 2014

(65) Prior Publication Data

US 2014/0247311 A1 Sep. 4, 2014

(30) Foreign Application Priority Data

Mar. 1, 2013 (JP) ..... 2013-040416

(51) Int. Cl.
*B41J 2/165* (2006.01)
*B41J 2/175* (2006.01)

(52) U.S. Cl.
CPC ..... *B41J 2/1752* (2013.01)

(58) Field of Classification Search
CPC ..... B41J 2/1752; B41J 2/1753; B41J 2/305; B41J 2/18; B41J 2002/12; B41J 2/17596; B41J 2/165
USPC ..... 347/84, 85, 86, 87
See application file for complete search history.

(56) References Cited

U.S. PATENT DOCUMENTS

| | | | | |
|---|---|---|---|---|
| 3,102,770 | A * | 9/1963 | McKeegan | 346/140.1 |
| 4,215,353 | A * | 7/1980 | Kaieda et al. | 347/6 |
| 5,489,931 | A * | 2/1996 | Shibata et al. | 347/85 |
| 6,084,617 | A * | 7/2000 | Balazer | 347/86 |
| 2005/0146175 | A1* | 7/2005 | Cottrell et al. | 297/217.1 |
| 2010/0238222 | A1* | 9/2010 | Jogo et al. | 347/14 |
| 2012/0127229 | A1* | 5/2012 | Fukasawa et al. | 347/16 |
| 2012/0256989 | A1* | 10/2012 | Uezawa et al. | 347/54 |

FOREIGN PATENT DOCUMENTS

| | | |
|---|---|---|
| JP | 2011-093222 | 5/2011 |
| JP | 2012-183715 | 9/2012 |

* cited by examiner

*Primary Examiner* — Geoffrey Mruk
*Assistant Examiner* — Scott A Richmond
(74) *Attorney, Agent, or Firm* — Workman Nydegger

(57) ABSTRACT

A liquid ejecting apparatus includes an ejecting head that is enabled to eject a liquid; a liquid supply portion for supplying the liquid from a liquid supply source to the ejecting head; a holding frame that holds the ejecting head, the liquid supply source and the liquid supply portion; and a movement mechanism that moves the holding frame. The liquid supply portion has a flow channel forming portion that forms a liquid flow channel connecting the liquid supply source and the ejecting head and a flow channel holding portion that holds the flow channel forming portion in a swayable manner.

12 Claims, 3 Drawing Sheets

LIQUID EJECTING APPARATUS

BACKGROUND

1. Technical Field

The present invention relates to a liquid ejecting apparatus which ejects a liquid such as an ink.

2. Related Art

Hitherto, as a liquid ejecting apparatus which ejects a liquid, there has been an ink jet-type printer that ejects an ink containing a component with a settling property such as a pigment onto a medium such as a sheet to perform printing.

In this printer, if the ink with the pigment settled down is ejected toward the paper, color irregularities on a printed portion of the paper occur, thereby leading to a possibility of deterioration in printing quality. However, in a case where an ejecting head which ejects the ink reciprocates while ejecting the ink, an ink tube which is connected to the ejecting head is displaced in accordance with a movement of the ejecting head causing the ink in the ink tube to flow so as to suppress settling of the pigment (For example, JP-A-2011-93222).

Incidentally, in the above-referenced printer, although a portion on a downstream side of an ink tube is displaced in accordance with a movement of an ejecting head, the ink does not flow at a portion on an upstream side of the ink tube which is connected to an ink cartridge that does not move, thereby leading to a disadvantage that a pigment settles down.

Such a disadvantage is not limited to the printer which ejects the ink containing the pigment but is substantially common in liquid ejecting apparatuses which eject a liquid of which characteristics are changed by being in a standstill state.

SUMMARY

An advantage of some aspects of the present invention is to provide a liquid ejecting apparatus in which a liquid that is present in the apparatus can flow when ejecting the liquid.

Hereinafter, means to solve the above-referenced disadvantage and an operational effect thereof will be described.

According to an aspect of the invention, there is provided a liquid ejecting apparatus including an ejecting head that is enabled to eject a liquid; a liquid supply portion for supplying the liquid from a liquid supply source to the ejecting head; a holding frame that holds the ejecting head, the liquid supply source and the liquid supply portion; and a movement mechanism that moves the holding frame. The liquid supply portion has a flow channel forming portion that forms a liquid flow channel connecting the liquid supply source and the ejecting head and a flow channel holding portion that holds the flow channel forming portion in a swayable manner.

In this configuration, when the holding frame moves, the flow channel forming portion held by the flow channel holding portion in the swayable manner sways so that the liquid in the liquid flow channel flows. Since the holding frame moves in a state of holding the liquid supply source and the liquid supply portion in addition to the ejecting head, the liquid present in the apparatus can flow when ejecting the liquid.

According to another aspect of the invention, there is provided the liquid ejecting apparatus further including a support table that can support a medium accepting the ejected liquid. The movement mechanism halts the holding frame at a home position that is set on a base end side of the support table when the liquid ejection is not performed, and meanwhile, moves the holding frame from the home position toward a leading edge side of the support table before the liquid ejection starts.

In this configuration, the holding frame moves from the home position that is set on the base end side of the support table toward the leading edge side of the support table before the ejecting head starts the liquid ejection, and thus, the flow channel forming portion sways in accordance with the movement thereof. Therefore, the liquid present in the liquid flow channel can flow before ejecting the liquid.

According to another aspect of the invention, there is provided the liquid ejecting apparatus in which the flow channel forming portion includes a region to be disposed to extend in a direction intersecting a moving direction of the holding frame, and the flow channel holding portion holds the region of the flow channel forming portion.

In this configuration, since the flow channel holding portion holds the region to be disposed to extend in the direction intersecting the moving direction of the holding frame of the flow channel forming portion, the flow channel forming portion sways easily in accordance with a movement of the holding frame, thereby enabling the liquid to flow before ejecting the liquid.

According to another aspect of the invention, there is provided the liquid ejecting apparatus in which the flow channel holding portion has a plurality of fixing members that fix the flow channel forming portion, and the plurality of fixing members are disposed at intervals away from each other.

In this configuration, since the plurality of fixing members that fix the flow channel forming portion are disposed at intervals away from each other, portions between a fixing member and another fixing member sway in accordance with the movement of the holding frame, thereby enabling the liquid to flow.

According to another aspect of the invention, there is provided the liquid ejecting apparatus further including a carriage that is held by the holding frame. The carriage holds the ejecting head and is capable of scanning in a scanning direction intersecting the moving direction of the holding frame. The liquid supply portion is disposed between the flow channel forming portion and the ejecting head and also has a pressure adjustment portion that adjusts a pressure in the ejecting head. The pressure adjustment portion is held by the carriage and provided with a diaphragm that is displaceable along the scanning direction.

In this configuration, the diaphragm provided in the pressure adjustment portion is displaced along the scanning direction of the carriage so as not to be easily displaced in a deflected manner when the liquid flows in the moving direction intersecting the scanning direction in accordance with the movement of the holding frame. Therefore, even if the liquid in the liquid flow channel flows in accordance with the movement of the holding frame, it is difficult that an influence of a pressure fluctuation reaches the inside of the ejecting head.

According to another aspect of the invention, there is provided the liquid ejecting apparatus in which the liquid supply portion additionally has a conveyance mechanism for conveying the liquid from the liquid supply source to the flow channel forming portion, and the conveyance mechanism is provided with a membrane member that is displaced in the deflected manner along the moving direction of the holding frame when conveying the liquid.

In this configuration, the membrane member can be displaced in the deflected manner along the moving direction of the holding frame, thereby enabling the liquid to flow which is in the liquid flow channel by displacing in the deflected manner in accordance with the movement of the holding frame, even when the conveyance mechanism does not convey the liquid.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of a liquid ejecting apparatus that is enabled to eject a liquid will be described with reference to the drawings.

The liquid ejecting apparatus is a printer, for example, which performs printing by ejecting the liquid onto a medium.

Figure 1:
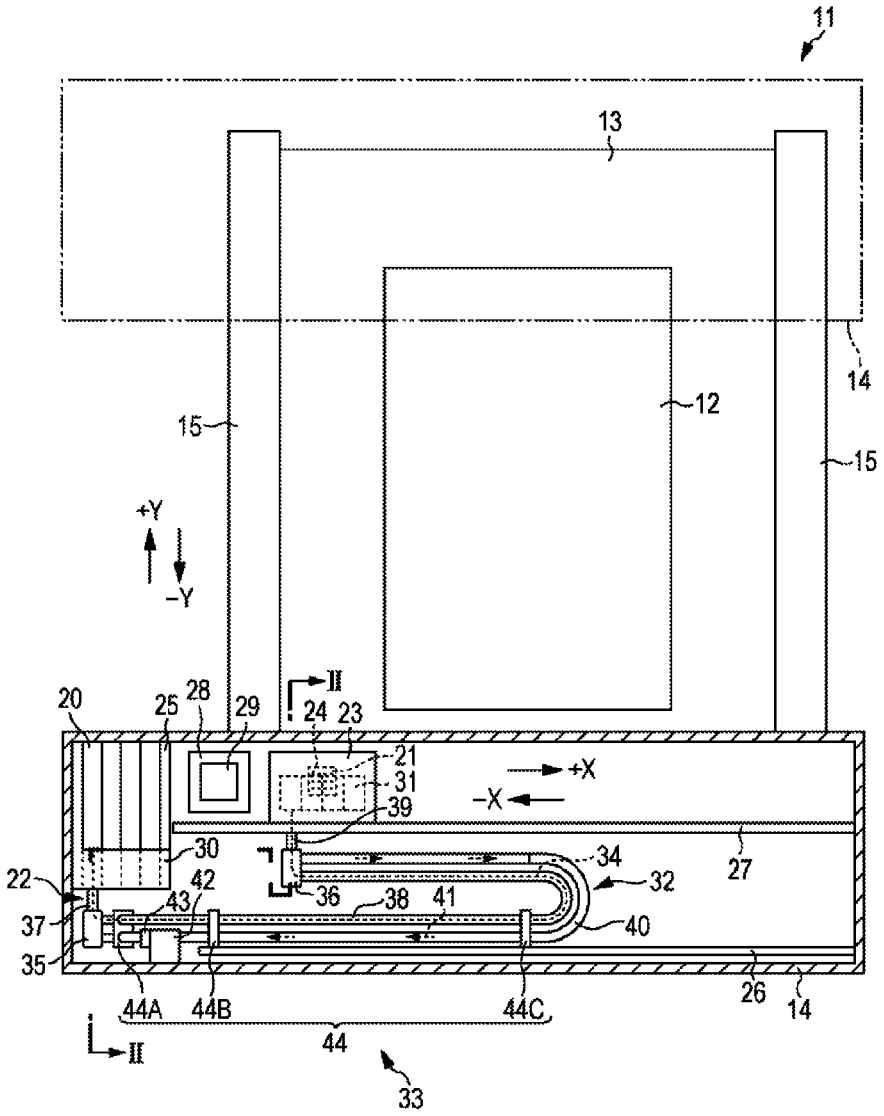
FIG. 1 is a cross-sectional view of a liquid ejecting apparatus in an embodiment.

As illustrated in FIG. 1, a liquid ejecting apparatus 11 in the present embodiment includes a support table 13 which can support a medium 12 accepting the ejected liquid, a holding frame 14 which is relatively movable with respect to the support table 13 and a movement mechanism 15 which moves the holding frame 14 in moving directions Y (positive Y, negative Y).

The liquid is an ink, for example. Particularly, the liquid ejecting apparatus 11 in the embodiment includes a solute such as a pigment particle having a greater specific gravity than that of a solvent such as a pigment ink and an ultraviolet curable-type ink (UV ink) so as to be effective for a solution in which the solute settles down and a deviation occurs in density by being in a standstill state. In addition, as the medium 12, for example, paper, a fabric, a resin membrane, a plate material having low flexibility and the like can be employed.

When the liquid ejecting apparatus 11 does not perform liquid ejection, the movement mechanism 15 halts the holding frame 14 at a home position (position of holding frame 14 indicated by a solid line in FIG. 1) which is set on a base end side of the support table 13 in moving directions Y.

In addition, before the liquid ejection starts in the liquid ejecting apparatus 11, the movement mechanism 15 moves the holding frame 14 in a moving direction positive Y from the home position toward a reference position (position of holding frame 14 indicated by a double-dashed chain line in FIG. 1) which is set on a leading edge side of the support table 13 in moving directions Y. At this time, the liquid ejecting apparatus 11 checks a position of the medium 12 which is placed on the support table 13. When the liquid ejecting apparatus 11 performs the liquid ejection, the movement mechanism 15 moves the holding frame 14 from the reference position in a moving direction negative Y.

The holding frame 14 holds a liquid supply source 20, an ejecting head 21 capable of ejecting the liquid, a liquid supply portion 22 for supplying the liquid from the liquid supply source 20 to the ejecting head 21 and a carriage 23. The liquid ejecting head 21 has a plurality of nozzles 24 open toward the support table 13. The carriage 23 holds the ejecting head 21 and has a configuration capable of scanning in scanning directions X (positive X, negative X) intersecting (crossing in this embodiment) the moving directions Y.

The carriage 23 is on a first end side (left end side in FIG. 1) in the scanning directions X, which is a halt position thereof. The carriage 23 performs reciprocal scanning by alternatively performing outward scanning as moving from the halt position in the scanning direction positive X (direction to right in FIG. 1) and backward scanning as moving in the scanning direction negative X (direction to left in FIG. 1), thereby performing the reciprocal scanning in the scanning directions X.

In the holding frame 14, the moving directions Y are a short direction, while the scanning directions X intersecting the moving directions Y are a longitudinal direction. In the first end side (left side in FIG. 1) of the holding frame 14 in the longitudinal direction, a mounting portion 25 capable of holding the liquid supply source 20 is disposed.

The liquid supply source 20 is, for example, an accommodation container capable of accommodating the liquid. The liquid supply source 20 may be a cartridge supplementing the liquid by exchanging the accommodation container and may be an accommodation tank fixed to the mounting portion 25. If the liquid supply source 20 is the cartridge, the mounting portion 25 holds the liquid supply source 20 in an attachable and detachable manner. The mounting portion 25 may be configured to be able to hold the plurality of liquid supply sources 20 in which accommodated liquids differ from each other by type or by color.

When considering that the holding frame 14 has a moving direction positive Y side as a front side and a moving direction negative Y side as a rear side, a fixing wall 26 extending in the longitudinal direction is disposed on the rear side in the holding frame 14. In addition, in front of the fixing wall 26 in the holding frame 14, a guide wall 27 extending in the scanning directions X is disposed.

A rear surface side of the carriage 23 is connected to the guide wall 27 positioned on the backside thereof in a state where the scanning in the scanning directions X is possible. The guide wall 27 guides the reciprocal scanning of the carriage 23 along the scanning directions X. In addition, a region on the front side of the guide wall 27 in the holding frame 14 is a scanning region of the carriage 23.

The carriage 23 holds the ejecting head 21 at a position (below in a gravity direction in the embodiment) facing the support table 13. In addition, on the first end side (left end side in FIG. 1) in the scanning region of the carriage 23 which is a position corresponding to the halt position of the carriage 23, a maintenance device 28 for performing maintenance of the ejecting head 21 is disposed.

The maintenance device 28 includes an absorption mechanism 29 capable of absorbing the liquid in the ejecting head 21. The absorption mechanism 29 absorbs the liquid in the ejecting head 21 through the nozzles 24 so as to perform cleaning of the ejecting head 21.

Next, a configuration of the liquid supply portion 22 will be described in detail.

The liquid supply portion 22 has a conveyance mechanism 30 disposed in a rear portion of the mounting portion 25, a pressure adjustment portion 31 held by the carriage 23, a flow channel forming portion 32 disposed between the conveyance mechanism 30 and the pressure adjustment portion 31 and a flow channel holding portion 33 holding the flow channel forming portion 32 in a swayable manner.

The conveyance mechanism 30, the pressure adjustment portion 31 and the flow channel forming portion 32 may be disposed in plural numbers in accordance with the number of the liquid supply sources 20 installed. In FIG. 1, the conveyance mechanism 30, the pressure adjustment portion 31 and the flow channel forming portion 32 are illustrated in plural numbers so as to respectively correspond to the plurality of liquid supply sources 20.

The flow channel forming portion 32 forms a liquid flow channel 34 which connects the liquid supply source 20 and the ejecting head 21. In FIG. 1, only one of the flow channel forming portions 32 which is connected to the liquid supply source 20 accommodating a white ink is illustrated, for example, and no other flow channel forming portion 32 is illustrated. Other flow channel forming portions 32 which are not illustrated may have the same configuration as the illustrated flow channel forming portion 32 and may have a different configuration.

The flow channel forming portion 32 has a first relay member 35, a second relay member 36, a first flow channel forming portion 37, a second flow channel forming portion 38, a third flow channel forming portion 39 and a circulation flow channel forming portion 40. The second flow channel forming portion 38 and the circulation flow channel forming portion 40 are approximately the same in length. In addition, the second flow channel forming portion 38 and the circulation flow channel forming portion 40 are longer than the first flow channel forming portion 37 and the third flow channel forming portion 39, and for example, are formed of a tube having flexibility.

An upstream end of the first flow channel forming portion 37 is connected to the conveyance mechanism 30, while a downstream end thereof is connected to the first relay member 35. An upstream end of the third flow channel forming portion 39 is connected to the second relay member 36, while a downstream end thereof is connected to the pressure adjustment portion 31.

An upstream end of the second flow channel forming portion 38 is connected to the first relay member 35, while a downstream end thereof is connected to the second relay member 36. An upstream end of the circulation flow channel forming portion 40 is connected to the second relay member 36, while a downstream end thereof is connected to the first relay member 35. The first relay member 35, the second relay member 36, the second flow channel forming portion 38 and the circulation flow channel forming portion 40 form a circulation flow channel 41 indicating a flow direction by a dashed arrow line in FIG. 1.

In the circulation flow channel forming portion 40, there are disposed a circulation pump 42 for circulating the liquid that is supplied from the first flow channel forming portion 37 in the flow direction indicated by the dashed arrow line in FIG. 1 and a one-way valve 43 that is disposed on a downstream side of the circulation pump 42. The circulation pump 42 is driven when the liquid ejecting apparatus 11 is not performing the liquid ejection so as to circulate the liquid in the circulation flow channel 41, thereby suppressing a change in a characteristic of the liquid caused by the settling down of a solute.

In the circulation pump 42, for example, a tube pump can be employed which squashes a tube that is the circulation flow channel forming portion 40 in one direction for the liquid to flow. In addition, the one-way valve 43 allows the liquid that flows in the circulation flow channel forming portion 40 by driving the circulation pump 42 to flow from a second relay member 36 side to a first relay member 35 side while suppressing a reverse flow of the liquid from the first relay member 35 side to the second relay member 36 side.

The first relay member 35 changes an extending direction of the flow channel forming portion 32 which extends from the conveyance mechanism 30 to the back side into the scanning direction positive X. In addition, the second relay member 36 changes the extending direction of the flow channel forming portion 32 which extends to the scanning direction negative X into the moving direction positive Y that becomes a carriage 23 side.

The flow channel holding portion 33 has a plurality (for example, three) of fixing members 44 (44A, 44B, 44C) which fix the second flow channel forming portion 38 and the circulation flow channel forming portion 40 in a bundle. The plurality of fixing members 44 are disposed at intervals away from each other along the scanning directions X which becomes the extending direction of the second flow channel forming portion 38 and the circulation flow channel forming portion 40.

In the flow channel forming portion 32, the fixing member 44A is disposed between the first relay member 35, and the one-way valve 43, while the fixing members 44B and 44C are disposed between the circulation pump 42 and the second relay member 36. In addition, in the scanning directions X, the fixing member 44B is disposed in the vicinity of the halt position of the carriage 23, while the fixing member 44C is disposed in the vicinity of the center in the scanning region of the carriage 23.

The fixing members 44B and 44C hold the second flow channel forming portion 38 and the circulation flow channel forming portion 40 in the swayable manner by fixing the second flow channel forming portion 38 and the circulation flow channel forming portion 40 to the fixing wall 26 in a state where the second flow channel forming portion 38 and the circulation flow channel forming portion 40 have a sufficient length so as to be deflected downward between the fixing member 44B and the fixing member 44C. Meanwhile, the fixing member 44A bundles the second flow channel forming portion 38 and the circulation flow channel forming portion 40 to hold the second flow channel forming portion 38 and the circulation flow channel forming portion 40 in the swayable manner between the conveyance mechanism 30 and the fixing member 44B which are fixed to the holding frame 14.

The second flow channel forming portion 38 and the circulation flow channel forming portion 40 are bent between the fixing member 44C and the second relay member 36 so as to change the extending direction from the scanning direction positive X to the scanning direction negative X. When the carriage 23 performs reciprocal scanning in the scanning directions X, the second flow channel forming portion 38 and the circulation flow channel forming portion 40 which are positioned between the fixing member 44C and the second relay member 36 are displaced in the deflected manner in accordance with the scanning of the carriage 23. At this time, displacement of the second flow channel forming portion 38 and the circulation flow channel forming portion 40 in the moving directions Y is regulated by the fixing wall 26 and the guide wall 27.

Figure 2:
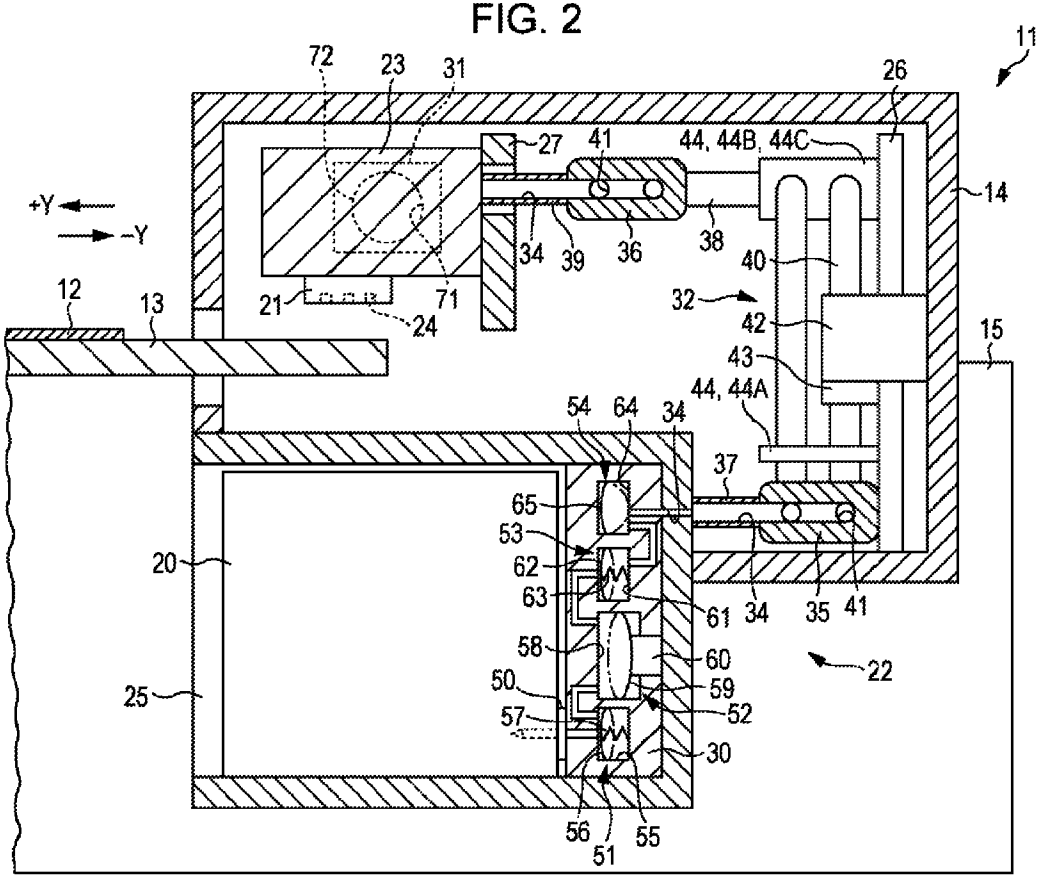
FIG. 2 is a cross-sectional view which is viewed from an arrow direction of line II-II in FIG. 1.

As illustrated in FIG. 2, the ejecting head 21 is disposed farther upward in the gravity direction than the liquid supply source 20. In addition, the fixing members 44B and 44C are disposed farther upward than the fixing member 44A. That is, the second flow channel forming portion 38 and the circulation flow channel forming portion 40 are drawn around vertically between the fixing member 44A and the fixing member 44B. Moreover, the one-way valve 43 and the circulation pump 42 are disposed between the fixing member 44A and the fixing member 44B in the gravity direction.

Next, a configuration of the conveyance mechanism 30 will be described in detail.

The conveyance mechanism 30 includes a connection portion 50 with respect to the liquid supply source 20, an absorption valve 51, a conveyance pump 52 and a discharge valve 53 to convey the liquid from the liquid supply source 20 to the flow channel forming portion 32. In addition, the conveyance mechanism 30 includes a choke valve 54. The absorption valve 51, the conveyance pump 52, the discharge valve 53 and the choke valve 54 are disposed so as to be in line from a connection portion 50 side toward a first flow channel forming portion 37 side in the liquid flow channel 34.

The absorption valve 51 includes an absorption valve chamber 55 communicating with a liquid flow channel 34 in the conveyance mechanism 30, a membrane member 56 which is disposed in the absorption valve chamber 55 and enabled to be displaced in the deflected manner along the moving directions Y and a first biasing member 57 biasing the membrane member 56 toward the moving direction positive Y which is an upstream side. The first biasing member 57 is a coil spring, for example. When the conveyance pump 52 is not driven, the absorption valve 51 is in a closed-valve state by a biasing force of the first biasing member 57 as indicated by the solid line in FIG. 2.

The conveyance pump 52 includes a pump chamber 58 communicating with the liquid flow channel 34 in the conveyance mechanism 30, a membrane member 59 which is disposed in the pump chamber 58 and enabled to be displaced in the deflected manner along the moving directions Y and an actuator 60 which moves the membrane member 59 in a direction (moving directions Y) where a volume of the pump chamber 58 increases and decreases.

The discharge valve 53 includes a discharge valve chamber 61 communicating with the liquid flow channel 34 in the conveyance mechanism 30, a membrane member 62 which is disposed in the discharge valve chamber 61 and enabled to be displaced in the deflected manner along the moving directions Y and a second biasing member 63 biasing the membrane member 62 toward the moving direction positive Y which is the upstream side. The second biasing member 63 is a coil spring, for example. When the conveyance pump 52 is not driven, the discharge valve 53 is in the closed-valve state by the biasing force of the second biasing member 63 as indicated by the solid line in FIG. 2.

When conveying the liquid from the liquid supply source 20 to the flow channel forming portion 32, the actuator 60 of the conveyance pump 52 is driven to displace the membrane member 59 in the deflected manner in the direction (moving direction positive Y) where the volume of the pump chamber 58 decreases. Accordingly, the membrane member 59 is displaced in the deflected manner from a position indicated by the solid line in FIG. 2 to a position indicated by the double-dashed chain line in the same drawing, and thus, the liquid which flowed out from the pump chamber 58 flows into the absorption valve chamber 55 and the discharge valve chamber 61.

Upon this, in accordance with an inflow of the liquid into the discharge valve chamber 61, the membrane member 62 of the discharge valve 53 is displaced in the deflected manner against the biasing force of the second biasing member 63 in the moving direction negative Y, thereby changing from the closed-valve state indicated by the solid line in FIG. 2 to an open-valve state indicated by the double-dashed chain line in the same drawing. Accordingly, the liquid in the conveyance mechanism 30 is conveyed toward the flow channel forming portion 32.

Subsequently, the actuator 60 of the conveyance pump 52 displaces the membrane member 59 in the deflected manner in the direction (moving direction negative Y) where the volume of the pump chamber 58 increases. Upon this, the liquid of the absorption valve chamber 55 and the discharge valve chamber 61 is absorbed to the pump chamber 58, and thus, the membrane member 62 of the discharge valve 53 is displaced in the deflected manner in the moving direction positive Y, and the discharge valve 53 is in the closed-valve state. Meanwhile, the absorption valve 51 is changed from the closed-valve state indicated by the solid line in FIG. 2 to the open-valve state indicated by the double-dashed chain line in the same drawing by displacing the membrane member 56 in the deflected manner in the moving direction negative Y against the biasing force of the first biasing member 57. Accordingly, the liquid in the liquid supply source 20 is absorbed into the conveyance mechanism 30.

The conveyance pump 52 alternatively performs discharge driving in which the membrane member 59 is displaced in the moving direction positive Y to convey the liquid to the flow channel forming portion 32 side and absorption driving in which the membrane member 59 is displaced in the moving direction negative Y to absorb the liquid from the liquid supply source 20, thereby conveying the liquid in the liquid supply source 20 toward the flow channel forming portion 32. The conveyance pump 52 is intermittently driven to maintain the inside of the liquid flow channel 34 to be in a pressured state in order to convey the liquid to the ejecting head 21 which is at a higher position than the liquid supply source 20.

The choke valve 54 includes a valve chamber 64 communicating with the liquid flow channel 34 in the conveyance mechanism 30 and a membrane member 65 which is disposed in the valve chamber 64 and is enabled to be displaced in the deflected manner along the moving directions Y. The choke valve 54 is in the open-valve state indicated by the solid line in FIG. 2 when a pressure in the valve chamber 64 is a positive pressure.

In the choke valve 54, if the liquid in the liquid flow channel 34 is discharged by being absorbed to the ejecting head 21 so that the farther downstream side of the membrane member 65 is in a negative pressure smaller than a predetermined value, the membrane member 65 is in the closed-valve state indicated by the double-dashed chain line in FIG. 2. If the conveyance pump 52 is driven in this state to cause the liquid to flow into the valve chamber 64, the choke valve 54 is in the open-valve state, thereby allowing the liquid to flow to the downstream side.

The valve closing of the choke valve 54 by an absorption and a discharge of the liquid and the valve opening of the choke valve 54 by driving of the conveyance pump 52 following thereafter are sometimes executed as a so-called choke cleaning to discharge the liquid inside the liquid flow channel 34, the pressure adjustment portion 31 and the ejecting head 21.

Next, a configuration of the pressure adjustment portion 31 will be described in detail.

The pressure adjustment portion 31 is a so-called self-sealing valve disposed between the flow channel forming portion 32 and the ejecting head 21. The pressure adjustment portion 31 adjusts a pressure in the ejecting head 21 which is a back pressure of the nozzles 24. It is preferable that the pressure adjustment portion 31 be disposed above the ejecting head 21.

Figure 3:
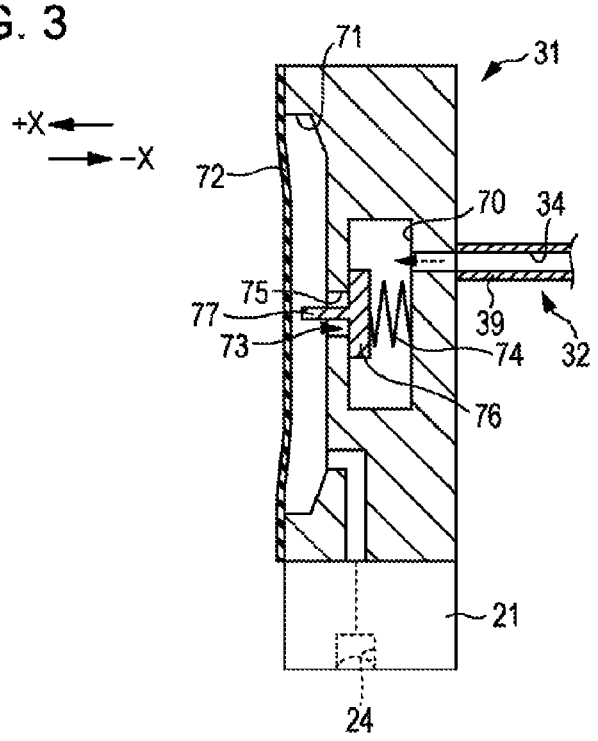
FIG. 3 is a cross-sectional view schematically illustrating a configuration of a pressure adjustment portion.

As illustrated in FIG. 3, the pressure adjustment portion 31 includes a supply chamber 70 communicating with the third flow channel forming portion 39, a pressure chamber 71 communicating with the nozzles 24, a diaphragm 72 which is enabled to be displaced in the deflected manner along the scanning directions X, a valve body 73 and a third biasing member 74 accommodated in the supply chamber 70. The third biasing member 74 is the coil spring, for example.

The supply chamber 70 and the pressure chamber 71 communicate with each other through a communication hole 75.

In addition, the valve body 73 has a main body portion 76 receiving the biasing force of the third biasing member 74 toward the scanning direction positive X in the supply chamber 70 and a protrusion portion 77 of which tip end protrudes to a pressure chamber 71 side through the communication hole 75.

The supply chamber 70, the communication hole 75 and the pressure chamber 71 are in line along the scanning directions X. The valve body 73 has a configuration enabling the communication hole 75 to be blocked as illustrated in FIG. 3 by the biasing force of the third biasing member 74.

The diaphragm 72 configures a portion of a wall surface of the pressure chamber 71 and receives atmospheric pressure on an outer surface side (left surface side in FIG. 3) while receiving a pressure of the liquid in the pressure chamber 71 on an inner surface side (right surface side in FIG. 3). Therefore, the diaphragm 72 is displaced in the deflected manner along the scanning directions X in accordance with the pressure change in the pressure chamber 71.

Here, in order to form a concave-shaped meniscus which is suitable for the liquid ejection in the nozzles 24, inside of the pressure chamber 71 is maintained in a negative pressure state within a predetermined range. The meniscus denotes a curved liquid surface which occurs due to a magnitude correlation of an adhesive force that works when the liquid comes into contact with the nozzles 24 and a cohesive force between liquid molecules.

Meanwhile, the supply chamber 70 is maintained in a pressurized state by the liquid which is pressurized to be conveyed as indicated by the dashed arrow line in FIG. 3. When the ejecting head 21 is not ejecting the liquid, the valve body 73 regulates the communication between the pressure chamber 71 in the negative pressure state and the supply chamber 70 in the pressurized state by the biasing force of the third biasing member 74.

Next, an operation of the pressure adjustment portion 31 will be described.

Figure 4:
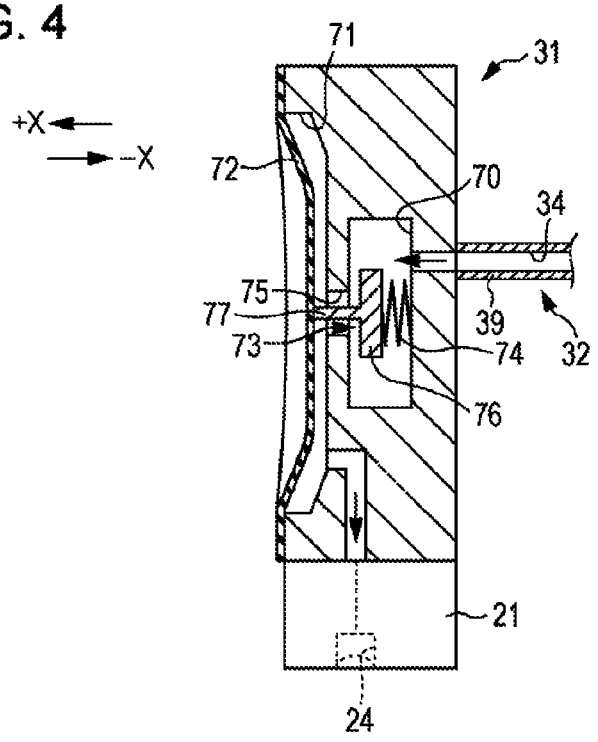
FIG. 4 is a cross-sectional view describing an operation of the pressure adjustment portion.

FIG. 4 illustrates the pressure adjustment portion 31 at the time of liquid ejection by the ejecting head 21. If the ejecting head 21 ejects the liquid, the liquid flows from the pressure chamber 71 as indicated by an arrow in FIG. 4. Upon this, since the pressure in the pressure chamber 71 is lowered, the diaphragm 72 which is displaced in the deflected manner in the scanning direction negative X abuts on the protrusion portion 77, and thus, the valve body 73 is separated from the communication hole 75 against the biasing force of the third biasing member 74. Accordingly, the liquid flows from the supply chamber 70 in the pressurized state into the pressure chamber 71.

As the pressure in the pressure chamber 71 rises due to an inflow of the liquid, the diaphragm 72 is displaced in the deflected manner in the scanning direction positive X. Upon this, as illustrated in FIG. 3, the valve body 73 abuts again on the communication hole 75, thereby regulating the communication between the pressure chamber 71 and supply chamber 70. In this manner, the inside of the pressure chamber 71 is maintained in the negative pressure state which is suitable for the liquid ejection by a pressure adjustment function of the pressure adjustment portion 31.

Next, an operation of the liquid ejecting apparatus 11 having the above-referenced configuration will be described.

Before the liquid ejecting apparatus 11 performs printing, the movement mechanism 15 moves the holding frame 14 which is at the home position in the moving direction positive Y. Upon this, in accordance with the movement of the holding frame 14, the flow channel forming portion 32 including the second flow channel forming portion 38 and the circulation flow channel forming portion 40 which are extended in the scanning directions X sways in the moving directions Y, and thus, the liquid in the liquid flow channel 34 flows.

In addition, when the liquid ejecting apparatus 11 performs the printing, the movement mechanism 15 moves the holding frame 14 from the reference position to a position where the medium 12 is placed in the moving direction negative Y. Then, after the ejecting head 21 reaches a position facing the medium 12, the movement mechanism 15 intermittently moves the holding frame 14 in the moving direction negative Y.

During the intermittent movement of the holding frame 14, the carriage 23 performs the reciprocal scanning in the scanning directions X. During the scanning, the ejecting head 21 ejects the liquid to perform the printing toward the medium 12. That is, since the movement mechanism 15 moves the holding frame 14 during the scanning of the carriage 23 accompanying the liquid ejection, in each movement thereof, the flow channel forming portion 32 held by the holding frame 14 sways in the moving directions Y so that the liquid in the liquid flow channel 34 flows.

As described above, in the liquid ejecting apparatus 11, when the liquid is not ejected, the liquid flows in the circulation flow channel 41 by the driving of the circulation pump 42. Meanwhile, when the circulation pump 42 is not driven, the liquid therein flows by swaying of the flow channel forming portion 32 accompanied by the movement of the holding frame 14.

In the flow channel holding portion 33, an upstream side is connected to the conveyance mechanism 30 which is fixed to the holding frame 14, while a downstream side is connected to the carriage 23 scanning in the scanning directions X. Therefore, in the second flow channel forming portion 38 and the circulation flow channel forming portion 40, a movable portion between the fixing member 44C and the second relay member 36 is displaced in accordance with the movement of the carriage 23. Accordingly, when the carriage 23 moves, the liquid flows inside the movable portion of the second flow channel forming portion 38 and the circulation flow channel forming portion 40.

Meanwhile, in the second flow channel forming portion 38 and the circulation flow channel forming portion 40, a portion between the conveyance mechanism 30 and the fixing member 44C is held by the flow channel holding portion 33 in a deflected state so as to have a sufficient length. Therefore, regions in the flow channel forming portion 32, particularly a region between the fixing member 44A and the fixing member 44B and a region between the fixing member 44B and the fixing member 44C are disposed to extend in a direction intersecting the moving direction of the holding frame 14, thereby greatly swaying every time the holding frame 14 intermittently moves. That is, the flow channel forming portion 32 includes the region to be disposed to extend in the scanning directions X intersecting the moving direction of the holding frame 14. The flow channel holding portion 33 holds a region in which the flow channel forming portion 32 extends in the scanning directions X.

Moreover, the conveyance mechanism 30 includes the membrane members 56, 59, 62 and 65 which are enabled to be displaced in the deflected manner along the moving directions Y when conveying the liquid. Therefore, not only when the conveyance pump 52 is driven but also when the conveyance pump 52 is not driven, the membrane members 56, 59, 62 and 65 are displaced in the deflected manner in accordance with the movement of the holding frame 14, and thus, the liquid in the liquid flow channel 34 flows.

If the liquid flows in the liquid flow channel 34, the liquid is stirred, thereby suppressing the change in the characteristic of the liquid caused by the settling down of the solute. However, if the pressure fluctuation generated by the flow of the liquid reaches the ejecting head 21, there is a possibility that an ejecting amount of the liquid or a spatter direction of a liquid droplet may change.

In this respect, since the holding frame 14 does not move when ejecting the liquid, the flow of the liquid accompanied by the movement of the holding frame 14 has little influence on the ejection of the liquid. Moreover, since the diaphragm 72 of the pressure adjustment portion 31 which supplies the liquid to the ejecting head 21 is hardly displaced in the deflected manner in the moving directions Y, the flow of the liquid in the liquid flow channel 34 accompanied by the movement of the holding frame 14 has less influence on the ejection of the liquid.

According to the embodiment, it is possible to achieve the effects described below.

(1) When the holding frame 14 moves, the flow channel forming portion 32 which is held in the swayable manner by the flow channel holding portion 33 sways so that the liquid in the liquid flow channel 34 flows. Then, since the holding frame 14 moves in a state of holding the liquid supply source 20 and the liquid supply portion 22 in addition to the ejecting head 21, when ejecting the liquid, it is possible for the liquid present in the apparatus to flow.

(2) The holding frame 14 moves from the home position toward the reference position before the ejecting head 21 starts the liquid ejection, and thus, the flow channel forming portion 32 sways in accordance with the movement thereof. Therefore, it is possible for the liquid present in the liquid flow channel 34 to flow before the liquid ejection.

(3) The flow channel holding portion 33 holds the region to be disposed to extend in the direction intersecting the moving direction of the holding frame 14 of the flow channel forming portion 32, and thus, the flow channel forming portion 32 sways easily in accordance with the movement of the holding frame 14. Therefore, it is possible for the liquid to flow.

(4) The plurality of fixing members 44 which fix the flow channel forming portion 32 are disposed at intervals away from each other, and thus, the portion between the fixing member 44 and another fixing member 44 sways in accordance with the movement of the holding frame 14. Therefore, it is possible for the liquid to flow.

(5) The diaphragm 72 included in the pressure adjustment portion 31 is displaced along the scanning directions X of the carriage 23, thereby it being difficult for the diaphragm 72 to be displaced in the deflected manner when the liquid flows in the moving directions Y intersecting the scanning directions X in accordance with the movement of the holding frame 14. Therefore, even though the liquid in the liquid flow channel 34 flows in accordance with the movement of the holding frame 14, it is difficult that the inside of the ejecting head 21 is influenced by the pressure fluctuation.

(6) The membrane members 56, 59, 62 and 65 are enabled to be displaced in the deflected manner along the moving directions Y of the holding frame 14, and thus, even when the conveyance mechanism 30 does not convey the liquid, it is possible for the liquid to flow in the liquid flow channel 34 by being displaced in the deflected manner in accordance with the movement of the holding frame 14.

The above-referenced embodiment may be modified as follows. In addition, the above-referenced embodiment and a below-described modification example can be arbitrarily combined.

A transportation mechanism which transports the medium 12 onto the support table 13 may be further included. In the embodiment described above, since the printing is performed without moving the medium 12, it is possible to employ the plate material having low flexibility, an object in a shape difficult to be transported and a metal body with a large gravitational force, as a medium.

Not including the carriage 23, the apparatus may be configured to have the holding frame 14 holding a full line head-type ejecting head 21 with a length which corresponds to the medium 12 in a width direction intersecting the moving directions Y.

The apparatus may be configured not to include the pressure adjustment portion 31 and may be configured to have the pressure adjustment portion 31 as a pressure damper not including the valve body 73. Otherwise, the pressure adjustment portion 31, not including the diaphragm 72, may be configured to be a sub tank which temporarily stores the liquid.

The diaphragm 72 of the pressure adjustment portion 31 may be disposed in an orientation from which the diaphragm is enabled to be displaced in the deflected manner toward the moving directions Y or the gravity direction. In this case, the diaphragm 72 is displaced in the deflected manner in accordance with the movement of the holding frame 14, and thus, it is possible for the liquid to flow.

The installation number and the disposition of the fixing member 44 can be arbitrarily changed.

A fixing member 44 in which the flow channel holding portion 33 and the fixing wall 26 are integrated may be included.

The flow channel holding portion 33 may include a holding member in a cylindrical shape or a coil shape having a larger diameter than the flow channel holding portion 33 causing the holding member to hold at least a portion of the flow channel forming portion 32 in the swayable manner. Otherwise, at least a portion of the flow channel forming portion 32 may be suspended in the swayable manner from a ceiling portion of the fixing wall 26 or the holding frame 14 by a net-shaped holding member. According to this configuration, even when the flexibility of the flow channel forming portion 32 is low, the flow channel forming portion 32 is swayed in accordance with the movement of the holding frame 14, and thus, it is possible for the liquid to flow which is present therein.

The flow channel holding portion 33 may be configured to separately hold the second flow channel forming portion 38 and the circulation flow channel forming portion 40.

The flow channel holding portion 33 may be configured to only hold either the second flow channel forming portion 38 or the circulation flow channel forming portion 40 in the swayable manner.

The flow channel holding portion 33 may hold a flow channel forming portion 32 other than the second flow channel forming portion 38 and the circulation flow channel forming portion 40.

The flow channel forming portion 32 may be configured not to include any or all of the first relay member 35, the second relay member 36 and the circulation flow channel forming portion 40.

The flow channel forming portion 32 may be formed of a tube having the total flexibility or may be formed of a tube having the partial flexibility.

In order to cause the liquid to flow in the liquid flow channel 34, the movement mechanism 15 may move the holding frame 14.

The apparatus may be configured not to include the choke valve 54.

The conveyance mechanism 30 may be configured not to include any or all of the membrane members 56, 59, 62 and 65.

The absorption valve 51 may be configured not to include the first biasing member 57. According to this configuration, it is possible to displace the membrane member 56 in the further deflected manner in accordance with the movement of the holding frame 14.

The discharge valve 53 may be configured not to include the second biasing member 63. According to this configuration, it is possible to displace the membrane member 62 in the further deflected manner in accordance with the movement of the holding frame 14.

In the gravity direction, the liquid supply source 20 may be at the same position as the ejecting head 21. The liquid supply source 20 may be disposed at a higher position than the ejecting head 21 so as to supply the liquid from the liquid supply source 20 to the ejecting head 21 by a differential head therebetween.

The movement mechanism 15 may be arbitrarily changed in the configuration and the disposition. For example, a drive source may be mounted to move the holding frame 14 on the holding frame 14 side.

The liquid ejected by the liquid ejecting apparatus 11 may be a liquid not including the solute. Even in this case, it is possible to suppress the deviation in temperature by causing the liquid to flow.

In each of the above-referenced embodiment, the liquid ejecting apparatus may be a liquid ejecting apparatus which ejects or discharges a liquid other than the ink. As a state of the liquid which is discharged from the liquid ejecting apparatus as a liquid droplet in a minute amount, a granular shape, a tear shape and a long-tailed thread shape are included. In addition, a liquid referenced hereupon may be any material as long as it can be ejected from a liquid ejecting apparatus. For example, it may be in any state as long as the substance is in a liquid phase, thereby including fluidal bodies such as a liquid body having high or low viscosity, a sol, gel water, other inorganic solvents, an organic solvent, a solution, a liquid resin, and a liquid metal (metal melt). In addition to the possible state of the substance of the liquid, a substance in which particles of a functional material consisting of a solid body such as the pigment and metal particles are dissolved, dispersed or mixed may be included. As a representative example of the liquid, the ink referenced in the embodiment or a liquid crystal can be exemplified. Here, the ink includes various liquid compositions such as an ordinary water based ink and oil based ink, gel ink, hot melt ink and the like. As a specific example of the liquid ejecting apparatus, there is a liquid ejecting apparatus ejecting a liquid which includes a material such as an electrode material that is employed in manufacturing a liquid crystal display, an electroluminescence (EL) display, a screen luminescence display and a color filter and a coloring material in a dispersed form or a dissolved form. In addition, the apparatus may be a liquid ejecting apparatus ejecting a living body organic matter employed for manufacturing a biochip, a liquid ejecting apparatus employed as a precision pipette to eject a liquid becoming a specimen, printing equipment, a micro-dispenser and the like. Moreover, the apparatus may be a liquid ejecting apparatus ejecting a lubricant at a pin-point onto a precision machine such as a time piece and a camera, and may be a liquid ejecting apparatus ejecting a transparent resin liquid such as an ultraviolet curing resin onto a substrate in order to form a micro hemispherical lens (optical lens) employed in an optical communication element and the like. In addition, the apparatus may be a liquid ejecting apparatus ejecting an etching solution such as an acid and an alkali in order to perform etching on the substrate and the like.

The entire disclosure of Japanese Patent Application No. 2013-040416, filed Mar. 1, 2013 is expressly incorporated by reference herein.

What is claimed is:

1. A liquid ejecting apparatus comprising:

an ejecting head that is enabled to eject a liquid;

a liquid supply portion for supplying the liquid from a liquid supply source to the ejecting head, the liquid supply portion having a flow channel forming portion that forms a liquid flow channel connecting the liquid supply source and the ejecting head and a flow channel holding portion that holds the flow channel forming portion;

a holding frame that holds the ejecting head, the liquid supply source and the liquid supply portion;

a support table that can support a medium accepting the ejected liquid, and a movement mechanism including movement portions that are disposed adjacent to the support table and that moves the holding frame along the movement portions such that the holding frame is able to move in a reciprocal manner in a direction that is perpendicular to the direction that the ejecting head moves when ejecting the liquid onto a medium, wherein the flow channel holding portion fixes the liquid flow channel to the holding frame at two positions such that a region fixed between the two positions in the liquid flow channel sways when the movement mechanism moves the holding frame.

2. The liquid ejecting apparatus according to claim 1, wherein the region of the flow channel forming portion is disposed to extend in a direction intersecting a moving direction of the holding frame.

3. The liquid ejecting apparatus according to claim 1, wherein the flow channel holding portion has a plurality of fixing members that fix the flow channel forming portion, and the plurality of fixing members are disposed at intervals away from each other.

4. The liquid ejecting apparatus according to claim 1, further comprising:

a carriage that is held by the holding frame, wherein the carriage holds the ejecting head and is capable of scanning in a scanning direction intersecting the moving direction of the holding frame, the liquid supply portion is disposed between the flow channel forming portion and the ejecting head and also has a pressure adjustment portion that adjusts a pressure in the ejecting head, and the pressure adjustment portion is held by the carriage and provided with a diaphragm that is displaceable along the scanning direction.

5. The liquid ejecting apparatus according to claim 1, wherein the liquid supply portion additionally has a conveyance mechanism for conveying the liquid from the liquid supply source to the flow channel forming portion, and the conveyance mechanism is provided with a membrane member that is displaced in a deflected manner along the moving direction of the holding frame when conveying the liquid.

6. The liquid ejecting apparatus according to claim 1, further comprising:

a carriage held by the holding frame, the carriage holding the ejecting head and being capable of scanning in a scanning direction intersecting the moving direction of the holding frame, wherein a liquid flow channel has a movable region that is moved in accordance with scanning of the carriage, the movable region being different from the region fixed between the two position in the liquid flow channel.

7. The liquid ejecting apparatus according to claim 1, wherein the region of the flow channel forming portion is formed of a tube having flexibility and has a length longer than a distance between the two positions.

8. The liquid ejecting apparatus according to claim 7, wherein the region of the flow channel forming portion is formed of a tube having flexibility and is fixed so as to be deflected downward between the two positions.

9. The liquid ejecting apparatus according to claim 1, wherein the movement mechanism intermittently moves the holding frame.

10. The liquid ejecting apparatus according to claim 1, wherein the movement mechanism moves the holding frame from the reference position toward a home position that is set on a base end side of the support table when liquid ejection is performed.

11. A liquid ejecting apparatus comprising:

an ejecting head that is enabled to eject a liquid;

a liquid supply portion for supplying the liquid from a liquid supply source to the ejecting head, the liquid supply portion having a flow channel forming portion that forms a liquid flow channel connecting the liquid supply source and the ejecting head and a flow channel holding portion that holds the flow channel forming portion in a swayable manner;

a holding frame that holds the ejecting head, the liquid supply source and the liquid supply portion;

a movement mechanism that moves the holding frame in a direction that is perpendicular to the direction that the ejecting head moves when ejecting the liquid onto a medium; and a support table that can support a medium accepting the ejected liquid, wherein the flow channel holding portion fixes the liquid flow channel to the holding frame at two positions such that a region fixed between the two positions in the liquid flow channel sways when the movement mechanism moves the holding frame, wherein the movement mechanism halts the holding frame at a home position that is set on a base end side of the support table when liquid ejection is not performed, meanwhile, moves the holding frame from the home position toward a leading edge side of the support table before the liquid ejection starts.

12. A liquid apparatus comprising:

an ejecting head that is enabled to eject a liquid;

a liquid supply portion for supplying the liquid from a liquid supply source to the ejecting head, the liquid supply portion having a flow channel forming portion that forms a liquid flow channel connecting the liquid supply source and the ejecting head and a flow channel holding portion that holds the flow channel forming portion in a swayable manner;

a holding frame that holds the ejecting head, the liquid supply source and the liquid supply portion; and a movement mechanism that moves the holding frame, wherein the flow channel forming portion forms a circulation flow channel that circulates the liquid between the circulation flow channel and the liquid flow channel, wherein the liquid between the circulation flow channel and the liquid flow channel is caused to flow by a circulation pump driven when the liquid is not ejected onto a medium, and the liquid between the circulation flow channel and the liquid flow channel is caused to flow by the movement mechanism moving the holding frame when the circulation pump is not driven.

* * * * *